US011330681B2

(12) United States Patent
Erle et al.

(10) Patent No.: US 11,330,681 B2
(45) Date of Patent: May 10, 2022

(54) METHOD FOR COOKING FOOD IN A SOLID STATE MICROWAVE OVEN

(71) Applicant: NESTEC S.A., Vevey (CH)

(72) Inventors: Ulrich Johannes Erle, Cleveland, OH (US); Sumeet Dhawan, Streetsboro, OH (US)

(73) Assignee: Societe des Produits Nestle S.A., Vevey (CH)

( * ) Notice: Subject to any disclaimer, the term of this patent is extended or adjusted under 35 U.S.C. 154(b) by 454 days.

(21) Appl. No.: 16/343,091

(22) PCT Filed: Oct. 19, 2017

(86) PCT No.: PCT/EP2017/076761
§ 371 (c)(1),
(2) Date: Apr. 18, 2019

(87) PCT Pub. No.: WO2018/077722
PCT Pub. Date: May 3, 2018

(65) Prior Publication Data

US 2020/0053844 A1 Feb. 13, 2020

Related U.S. Application Data

(60) Provisional application No. 62/414,355, filed on Oct. 28, 2016.

(51) Int. Cl.
*H05B 6/68* (2006.01)
*H05B 6/64* (2006.01)
(Continued)

(52) U.S. Cl.
CPC ..... *H05B 6/688* (2013.01); *H05B 1/0263* (2013.01); *H05B 6/6432* (2013.01); *H05B 6/6447* (2013.01); *H05B 6/6467* (2013.01); *H05B 6/6491* (2013.01); *H05B 6/6494* (2013.01); *H05B 6/686* (2013.01); *H05B 6/687* (2013.01); *H05B 6/80* (2013.01); *H05B 2206/04* (2013.01)

(58) Field of Classification Search
CPC .. H05B 6/688; H05B 1/0263; H05B 2206/04; H05B 6/6432; H05B 6/6447; H05B 6/6467; H05B 6/6491; H05B 6/6494; H05B 6/686; H05B 6/687; H05B 6/705; H05B 6/80; Y02B 40/00
USPC ..... 219/703, 702, 716, 748, 761, 746, 747, 219/750, 695, 697
See application file for complete search history.

(56) References Cited

U.S. PATENT DOCUMENTS 5,558,800 A * 9/1996 Page ..... H05B 6/72 219/695
2010/0176121 A1* 7/2010 Nobue ..... H05B 6/705 219/716
2011/0297672 A1* 12/2011 Niklasson ..... H05B 6/6402 219/702

FOREIGN PATENT DOCUMENTS

EP 2182774 5/2010
EP 2306785 4/2011
(Continued)

*Primary Examiner* — Quang T Van
(74) *Attorney, Agent, or Firm* — K&L Gates LLP

(57) ABSTRACT

A method for heating or cooking a frozen food product with a susceptor in a solid state microwave oven includes placing the frozen food product with a susceptor into a microwave oven, heating the food product at a first heating step at a low absorption frequency, and heating the food product at a second heating step at a high absorption frequency.

16 Claims, 4 Drawing Sheets

(51) Int. Cl.

| | |
|---|---|
| ***H05B 6/72*** | (2006.01) |
| ***H05B 1/02*** | (2006.01) |
| ***H05B 6/80*** | (2006.01) |

(56) References Cited

FOREIGN PATENT DOCUMENTS

| | | |
|---|---|---|
| EP | 2475221 | 7/2012 |
| WO | 2011149275 | 12/2011 |

* cited by examiner

A )

B )

A )

B )

A)

B)

C)

D)

A)

B)

C)

D)

METHOD FOR COOKING FOOD IN A SOLID STATE MICROWAVE OVEN

CROSS REFERENCE TO RELATED APPLICATIONS

The present application is a National Stage of International Application No. PCT/EP2017/076761, filed on Oct. 19, 2017, which claims priority to U.S. Provisional Patent Application No. 62/414,355, filed on Oct. 28, 2016, the entire contents of which are being incorporated herein by reference.

The present invention relates to a method for heating or cooking a frozen food product with a susceptor in a solid state microwave oven.

Household microwave ovens are very common appliances with more than 90% household penetration in the US and comparable numbers in other industrialized countries. Besides the re-heating of leftovers, the preparation of frozen meals and snacks is considered to be the most important use of microwave ovens in the US. The main benefit of microwave ovens is their speed, which is a result of the penetration of the electromagnetic waves into the food products. Although this heating mechanism is sometimes called 'volumetric heating', it is important to know that the heating pattern is not very even throughout the volume of the food. In fact, there are several aspects of today's household microwave ovens and their interaction with food that can lead to unsatisfactory results: The vast majority of household microwave ovens have a magnetron as microwave source, because this device is inexpensive and delivers enough power for quick heating. However, the frequency of microwaves from magnetrons is not controlled precisely and may vary between 2.4 and 2.5 GHz (for most household ovens). Consequently, the pattern of high and low intensity areas in the oven cavity is generally unknown and may even vary during the heating process.

Solid State Microwave Technology is a new technology and offers several advantages over magnetron-based technology. The main difference lies in the precise control of the frequency, which is a result of a semiconductor-type frequency generator in combination with a solid state amplifier. The frequency is directly related to the heating pattern in the cavity, so a precise frequency control leads to a well-defined heating pattern. In addition, the architecture of a solid state system makes it relatively easy to measure the percentage of microwaves that are being reflected back to the launchers. This feature is useful for scanning the cavity with a radio frequency sweep and determining which frequency, i.e. pattern, leads to more absorption by the food and which is less absorbed. Multi-channel solid state systems offer additional flexibility in that the various sources can be operated at the same frequency, with the option of user-defined phase angles, or at different frequencies. The solid state microwave technology is further described for example in: P. Korpas et al., Application study of new solid-state high-power microwave sources for efficient improvement of commercial domestic ovens, IMPI's 47 Microwave Power, Symposium; and in R. Wesson, NXP RF Solid State cooking White Paper, NXP Semiconductors N.V., No. 9397 750 17647 (2015). Examples of such solid state microwave ovens are described in US2012/0097667(A1) and in US2013/0056460(A1).

Although Solid State Technology promises to improve the results of microwave heating, it cannot solve a well-known drawback of pure microwave heating: The surface tends to be colder than the sub-surface, because it is exposed to the cold air in the oven cavity. Under these circumstances, some important cooking cues, like browning and crisping, do not occur. It is therefore common to add microwave active packaging, so-called susceptors, to some dough-based frozen food products, for which browning and crisping is desired.

Microwave susceptors are materials that show a strong absorption of microwaves. Typically, the word 'susceptor' in the context of food products refers to a laminated packaging material with a thin layer of aluminum embedded between a polyester and a paper layer. The purpose of susceptors is to heat up to temperatures up to 220° C. in the microwave oven and to impart browning and crisping to the food surface. This concept requires a good contact between the susceptor and the food surface for sufficient heat transfer. However, it is a safety requirement to avoid temperatures well beyond 220° C., as they would create a fire hazard. In order to avoid the risk of a fire, standard microwave susceptors have a built-in safety mechanism. In case of overheating, these susceptors lose some of their electrical conductivity, and thus heating power, due to a phenomenon called 'cracking'. This is essentially the result of shrinkage in the polyester layer, tearing apart the thin aluminum layer.

The results from heating frozen food items with susceptors in a microwave oven can vary dramatically. Sometimes the level of browning and crisping of a food product is comparable to the application of another heat source, like hot air in a conventional oven, and sometimes the susceptor does not seem to have much of an effect at all. It is believed that the general variability of magnetron-based microwave ovens is even augmented as far as susceptor performance is concerned. Although solid state microwave ovens are more consistent than magnetron-based ones as they offer additional control parameters, they can also lead to a performance loss of susceptors.

Hence, there is a persisting need in the food industry to improve the method of heating and/or cooking a frozen food product in a microwave oven, particularly in a solid state microwave oven, when used in combination with a susceptor.

SUMMARY OF THE INVENTION

The object of the present invention is to improve the state of the art and to provide an improved solution to microwave heating of frozen food products to overcome at least some of the inconveniences described above.

Therefore, one of the objects of the present invention is a method for heating and/or cooking a frozen food product with a susceptor in a solid state microwave oven in a manner to improve browning and crispiness of the food product, and particularly of providing more even browning and crispiness of said food product than what can be achieved presently with prior art solutions.

A further object of the present invention is a method for heating and/or cooking a frozen food product with a susceptor in a solid state microwave oven specifically aimed at maximizing the efficacy, performance and/or reproducibility of said standard microwave susceptor.

The object of the present invention is achieved by the subject matter of the independent claims. The dependent claims further develop the idea of the present invention.

Accordingly, the present invention provides in a first aspect a method for heating a frozen food product with a susceptor in a solid state microwave oven, the method comprising the following steps in the following order:

a) placing the frozen food product with the susceptor into a cavity of a solid state microwave oven;

b) performing a radio frequency sweep between a predetermined minimal and maximal frequency for all channels;
c) analyzing the compound power return loss over the entire swept frequency range;
d) heating the food product in a first heating step at a radio frequency where the compound power return loss is below the median value of the total compound return loss determined over the entire swept frequency range;
e) heating the food product in a second heating step at a radio frequency where the compound power return loss is above the median value of the total compound return loss determined over the entire swept frequency range.

The inventors have observed that when heating a frozen food product together with a susceptor in a solid state microwave oven, the food product itself is not able to absorb a large part of the incident microwave power. In fact, and while the average field strength in the microwave oven is initially quite high, a large part of that incident microwave power is actually absorbed by the susceptor. In such a situation, there is a potential risk of overheating the susceptor and thereby triggering the built-in safety mechanism of the susceptor before the food product is actually defrosted and able to develop browning and crisping. Therefore, and without wanting to be bound by theory, the inventors believe that when the preparation of a food product in combination with a susceptor leads to unsatisfactory results in a microwave oven, the underlying reason may be that the susceptor could not deliver to its full potential, because its safety mechanism was triggered too early.

It has now been found by the inventors that when they apply a method for heating a frozen food product together with a susceptor in at least two independent heating steps in a microwave oven, whereby the first heating step is at a radio frequency where the compound power return loss is low, and then in a second consecutive heating step where the compound power return loss is high, much better results can be obtained as to overall and even-browning of the surface of the food product. Furthermore, crispiness of the food product was also improved and much more even over the surface of the food product. Still further it was observed that with the two step heating process much less moisture of the food product was lost if compared to corresponding single step prior art heating methods. Therefore, the method of the present invention provides a novel heating regime which allows to evenly well brown a food surface to provide for example an overall crispy pizza or enrolled dough product, and at the same time to reduce moisture loss and still providing a tender and not hard, tough textured food product. Evidence for those findings and further details are provided in the Examples section here below.

DETAILED DESCRIPTION OF THE INVENTION

Figure 1:
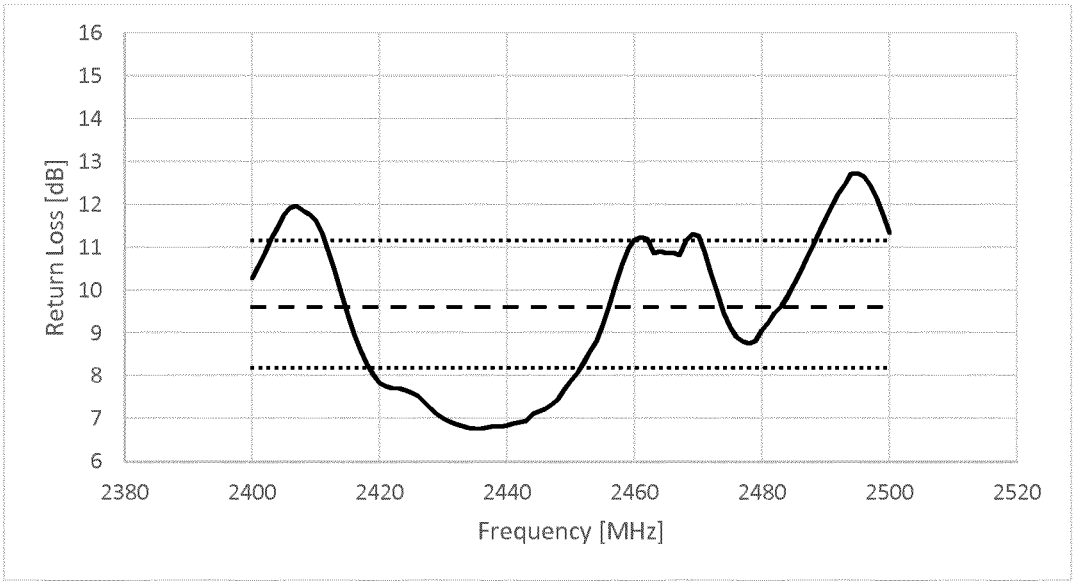
FIG. 1: Radio frequency sweep for determining the frequency for the first Phase heating step of Example 2. Solid line is the frequency sweep; the heavy dotted line is the median value of the frequency sweep; the light dotted lines are the mean values between the median and the maxima and minima values, respectively.
Figure 1:
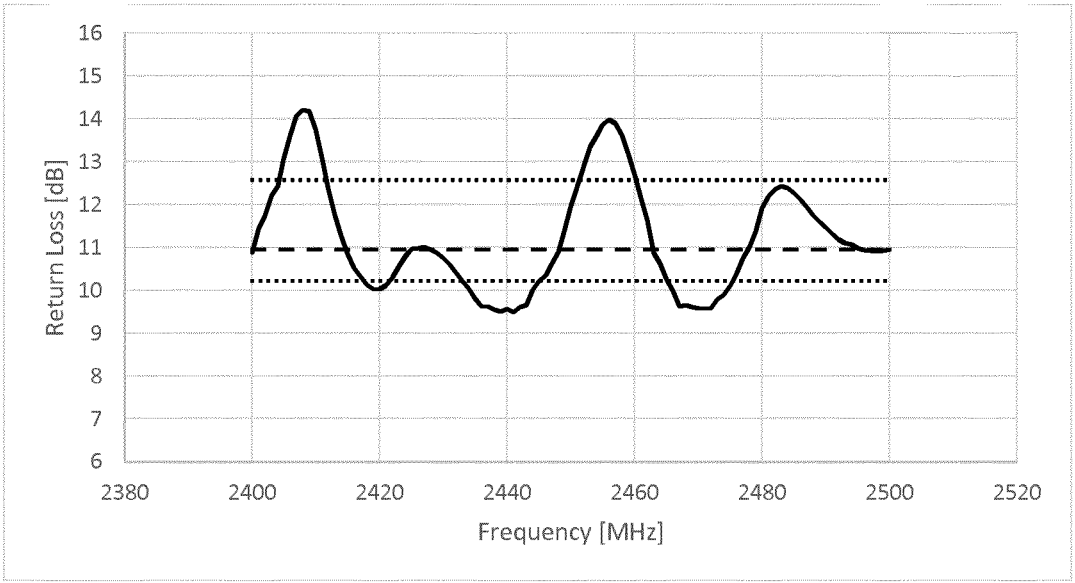

The present invention provides in a first aspect a method for heating a frozen food product with a susceptor in a solid state microwave oven, the method comprising the following steps in the following order:
a) placing the frozen food product with the susceptor into a cavity of a solid state microwave oven;
b) performing a radio frequency sweep between a predetermined minimal and maximal frequency for all channels;
c) analyzing the compound power return loss over the entire swept frequency range;
d) heating the food product in a first heating step at a radio frequency where the compound power return loss is below the median value of the total compound return loss determined over the entire swept frequency range;
e) heating the food product in a second heating step at a radio frequency where the compound power return loss is above the median value of the total compound return loss determined over the entire swept frequency range.

A "solid state microwave oven" is a microwave oven creating and applying electromagnetic energy from a solid-state source, such as for example from a transistor-based amplifier.

A "susceptor" is a material used for its ability to absorb electromagnetic energy and to convert it to heat. Susceptors are usually made of metallized film laminated to paper.

A "radio frequency sweep" is a scan of a radio frequency band, e.g. with the purpose of detecting or monitoring certain signals. As the frequency of a transmitter is changed to scan, i.e. sweep, a desired frequency band, signals such as the power return loss can be received at each frequency and be recorded.

A "compound power return loss" is the 'power return loss' compounded over all channels used in the scan. "Power return loss" is the return loss of power of a signal being returned after emission, for example in a microwave oven. Particularly, "power return loss" reflects here the power loss in decibels (dB) due to absorption by the material in the microwave oven cavity, e.g. the food product and susceptor, i.e. the power which is not reflected back to the emitters.

A "median value of the total compound return loss" is the median value separating the higher half of all the compound return loss data from a radio frequency sweep from the lower half.

In an embodiment of the present invention, the radio frequency sweep in step b) of the present method is from 900 to 5800 MHz. In a preferred embodiment of the present invention, the radio frequency sweep in step b) of the present method is from 2400 to 2500 MHz. Alternatively, the radio frequency sweep can also be from 902 to 928 MHz. The selection of a specific frequency band may depend on multiple considerations, such as for example the availability of a power source, the cavity size of the microwave oven, the size of the load to be heated in the cavity, and the desired penetration depth into the material to be heated.

In one embodiment, the radio frequency sweep in step b) of the method of the present invention is done separately for each channel. Alternatively in another embodiment, the radio frequency sweep in step b) of the method of the present invention is done collectively for all channels with constant phase angle. Such a phase angle can be defined and set in a solid state microwave oven by the user.

Solid state microwave ovens have a degree of heating process control unavailable with classical magnetron driven microwave ovens. With this additional control and feedback from the heating cavity of the oven, these solid state microwave ovens can determine how much power is reflected back and adapt the heating process accordingly. Thereby, the solid state microwave oven is then preferably operated at a power from 100 to 1600 Watts and for 30 seconds to 30 minutes.

In a further embodiment of the present invention, the first heating step in step d) of the present method is for a duration to defrost at least 50 vol % of the food product. Preferably, the first heating step in step d) is for a duration to defrost at least 80 vol % of the food product. More preferably, the first heating step in step d) is for a duration to completely defrost the food product. Once defrosted, the food product or the part of the food product which is defrosted is better able to absorb energy from the emitted radio frequency. This creates a competition between the food product and the susceptor for the available electromagnetic power. In this phase, the susceptor needs to be provided with enough microwave power to fulfill its role. It is then when preferably the radio frequency is changed to a frequency with a higher absorption of the radio frequency power by the food product and the susceptor, such as provided in the second heating step of the present method. Therefore, for example, the first heating step in step d) of the present method can be for a duration of at least 1.5 min, preferably at least 2 min, more preferably at least 2.5 min.

In a further embodiment of the present invention the first heating step in step d) of the present method is at a radio frequency where the compound power return loss is below an arithmetic mean of the median value and the minimal value of return loss determined over the entire swept frequency range and calculated on a decibel (dB) basis. The inventors have found that advantageously the radio frequency of the first heating step d) is selected such that the compound power return loss is as minimal as possible. The smaller the compound return loss, the less the risk of damaging the susceptor with a high load of energy. Preferably, the first heating step in step d) of the present method is at a radio frequency where the compound power return loss is at the minimum of the entire swept frequency range.

In a still further embodiment of the present invention the second heating step in step e) of the present method is at a radio frequency where the compound power return loss is above an arithmetic mean of the median value and the maximal value of return loss determined over the entire swept frequency range and calculated on a decibel (dB) basis. The inventors have found that advantageously the radio frequency of the second heating step d) is selected such that the compound power return loss is as high as possible. The bigger the compound return loss, the more energy can be absorbed by the food product. Furthermore, it is also now that the susceptor needs an optimal amount of power as it is converting this energy into heat to assure proper browning and crisping of the food surface. Preferably, the second heating step in step e) of the present method is at a radio frequency where the compound power return loss is at the maximum of the entire swept frequency range. Therefore, for example, the second heating step in step e) of the present method is for a duration of at least 1.5 min, preferably at least 2 min, more preferably at least 2.5 min.

In another embodiment of the present invention, the steps b) and c) of the present method are repeated before the second heating step of step e). In other words, a second radio frequency sweep over the entire selected frequency range with analyzing the resulting compound power return loss is performed after completion of the first heating step d) and before the second heating step e). It is then the result of this second radio frequency sweep and its analysis which is used to determine the radio frequency for the consecutive second heating step e). These additional steps of the present method allow to optimize the selection of the radio frequency for the second heating step. Such a second radio frequency sweep may be helpful also as the compound power return loss profile obtained from the initially frozen food product may have changed or shifted a little bit.

In a still further embodiment, the combination of the steps b), c) and e) of the present method is repeated at least twice. Hence, after a first part of the second heating step, the radio frequency may be swept for a third, fourth or even fifth time, and each time the selected radio frequency for the following consecutive heating step may be adjusted accordingly again. Hence, it may be possible to sweep the frequencies and adjust the selected radio frequency for the heating step once every one minute or every 30 seconds, for example. Hence, in another embodiment of the present invention, the method of the present invention pertains to a method where the radio frequency sweep with the compound power return loss analysis is repeated once every minute, once every 45, 30, 15 or 5 seconds, and where the radio frequency for the consecutive heating step is adjusted accordingly.

In an embodiment of the present invention, the frozen food product is a pizza product, a sandwich product, a bread product, an enrolled dough product with a filling, or a prepared meal product.

Those skilled in the art will understand that they can freely combine all features of the present invention disclosed herein. Further, features described for different embodiments of the present invention may be combined. Further advantages and features of the present invention are apparent from the figures and examples.

Example 1: General Methodology and Description

Microwave Ovens and their Specifications:

The following ovens were used for conducting the experiments reported herein:

- Standard home microwave (Sharp Carousel 1100 Watts): 1100 Watts; 11 power levels; 4 defrost options; 6 reheats options; countertop
- in-house developed Solid State microwave oven: Four-channel RF power amplifier (Ampleon), combined with a GE 'Café' 'Over-the-Range' Microwave/Hot Air oven cavity; 250 Watts/Channel; 1600 Watts convection; 3 adjustable fan speeds.

Description of the In-House Developed Solid State MW Oven:

The Solid State microwave oven used in this study is based on an NXP (now Ampleon, Netherlands) quad channel radiofrequency (RF) power amplifier combined with a GE 'Café' 'Over-the-Range' Microwave/Hot Air oven cavity. The quad channel system (QCS) is mobile, flexible and can be utilized by driving 1 to 4 channels coherently or independently. Each channel delivers 250 Watts between 2.4 and 2.5 GHz. The system is easy to use with a LabVIEW software interface. The system is robust and includes a door switch plug (connected to two independent door switches) to ensure microwaves do not operate when the cavity door is open.

The system rack consists of four Psango high performance RF power amplifiers based on laterally diffused metal oxide semiconductor (LDMOS) technology which have a heating efficiency close to 60%. Couplers and detectors are present in the system to measure the forward and reverse power per channel. The system is cooled by air with the help of large aluminium heat sinks. Each channel requires a power supply of 20 A at 28 V.

The cavity used in the study is a GE 'Café' 1.7 cu. ft. 'Over-the-Range' Microwave/Hot Air oven cavity. Dimensions of the cavity are 53.34×34.29×25.4 cm (W×L×H) with a 48 L volume. The original magnetron for the oven located on the top was removed, and the electronics were readjusted to ensure the safe operation of the oven. The convection system is 1.6 kW and can be operated up to 450° F. cavity temperature. Convection cooking controls include bake, fast bake, and roast with the roast function having the highest fan speed.

Tested Frozen Food Products:

The food products were stored in a freezer at 5° F. (−15° C.) for at least 24 hours prior to the testing. This ensured equilibration of the temperature throughout the products. The tested products used were from the US market: Single Serve DiGiorno Four Cheese Pizza and Four Cheese Hot Pocket products.

Product Quality Measurements after the Baking in the MW Oven:

Product performance was measured in terms of the following characteristics:

A. Percentage Weight Loss: Each product was weighed before placing it in the oven (Initial Weight) and after the product reconstitution (Final Weight). The percentage weight loss was measured using the formula:

$$[\text{Percentage Weight Loss}]=((\text{Initial weight}-\text{final weight})/\text{initial weight})\times 100$$

B. Sensory: The following scale was developed by a Sensory Scientist, and the products were evaluated on the following scale:
   - Crispiness (cut in the center): score 1 (not crispy) to score 5 (very crispy)
   - Crispiness (bit of corners): score 1 (not crispy) to score 5 (very crispy)
   - Toughness (pull of edge): score 1 (not tough) to score 5 (very tough)

C. Visual Observation: After every product reconstitution, product images were captured using a digital camera.

D. Percentage Browning: A DigiEye was used to measure the overall surface browning of the dough surface. It is a computer controlled digital camera system for measuring color and capturing high quality repeatable images. An image was captured by the calibrated digital camera which was followed by color measurement of the object image utilizing the DigiEye software. The DigiEye provides complex color data for each selected area and average values for the investigated samples as an arithmetic mean from values determined for particular selected areas. The measurement data were reported in terms of colorimetric values (XYZ and CIE L*a*b*) and spectral reflectance, ranging from 400 nm to 700 nm at 10 nm intervals. The Lab Color Scale was a 3-dimensional model made up of three axes: the L axis (luminance), ranging from black (0) to white (100), the a axis which extends from green (−a) to red (+a), and the b axis which ranges from blue (−b) to yellow (+b). Color parameters were calculated according to the "Observer" and "Illuminant". The cabinet was lit by a combination of fluorescent D65 illuminant and additive LEDs to allow the production of calibrated A-rated D65 simulator.

The food sample (Hot Pocket product or pizza) was placed in the DigiEye Cube with a blue plate to contrast and filter out the white lighting from the background. Diffuse illumination geometries were used in the process. It removes specular reflection from glossy and curved surfaces, enabling reliable measurements of the Hot Pocket products and pizza. Attached to the Cube, a digital SLR camera captures data at millions of points. Color and texture are recorded precisely and in extremely high resolution. Color measurement was performed for selected area of the investigated Hot Pocket sample using the DigiPix option. Selection of pixels for measurement was done using the 'Custom Pixel' function. The colorimetric values of the various brown hues were recorded and averaged out into four separate brown shades. Each unique brown shade detected was given a numerical value, computed through a formula and plotted on the 3-dimensional grid. Percentage browning in the study was calculated using L/a.

Example 2: Single Serve DiGiorno Four Cheese Pizza Product

This example highlights the results of improved browning and crispiness of a single serve pizza by optimizing the method for heating in a solid state microwave oven. The results from operating all channels at the same frequency are shown. The "Reference test" selected for this study is what a person skilled in the art would typically perform when using a solid state microwave oven, i.e. i) performing a radio frequency sweep between 2400-2500 MHz for all channels, ii) analysing the compound return loss to find the high absorption frequency, and then iii) cooking the food product at this high absorption frequency as it would be considered the most efficient way to cook the food product.

However, it might not be the optimum way to use a susceptor together with an initially frozen food product and to enhance browning and crispiness of this food product during the cooking process. In fact, the results from this example demonstrate that the ideal way to optimize susceptor performance in combination with a frozen food product would be to cook the pizza first at a low absorption frequency for a certain period of time to ensure that the food is defrosted or at least partly defrosted and then to cook the food for the rest of the time at a high absorption frequency to enhance the browning and crispiness.

Methodology and Protocol of the Experiment:

Example 1 summarizes the methodologies utilized for the study.

The following testing protocol was used in the reconstitution (heating) of the single serve pizza in the magnetron-based and solid state microwave ovens, respectively:

Sharp Carousel microwave (Magnetron 1100 Watts): The product was placed in the center on the turntable with the use of the susceptor as directed in the cooking instruction label. Product is cooked for 3 minutes and measured for performance.

Ampleon Experimental Solid State Combination Oven: The product was placed in the center of the turntable with the use of the susceptor. For all trials, the product was placed exactly at the same location to ensure repeatability. The turntable was inactivated, as solid state ovens generally do not require the turning motion for even heating. The cooking methodology in the solid state oven was either a one phase or two phase method.

Our reference test for this study was a one phase method where a high absorption single frequency (based on return loss data) was selected following the frequency sweep (scan) between 2400-2500 MHz. During the scan and also during the following cooking steps, all four channels of the experimental oven were operated at the same frequency.

Scanning Procedure:

The scan was conducted by applying microwaves in a sweep where the frequency was increased between 2400 and 2500 MHz in steps of 1 MHz. The applied power was 50 Watt per channel, and the scan took 8 seconds. The heating effect from the scan itself is considered negligible. The experimental oven measures the reflected power at each frequency and provides the result of the scan in the form of a return loss (in dB). A high return loss value means that a big portion of the incident microwave energy was absorbed in the cavity. Since the oven cavity is made of metal with relatively low absorption losses, it is assumed that most of the absorption takes place in the food product and susceptor.

The result of each scan is plotted in a way that allows for easy identification of the local and global maxima and minima. Three more reference lines mark a) The return loss for which half of the measured points are higher and half of the measured points are lower ("median")
b) The half difference (in dB) between the median and the global maximum ("50% line top") and
c) The half difference between the median and the global minimum ("50% line bottom").

When choosing a frequency for high absorption, it means that the return loss corresponding to the frequency has to be higher than the median of the scan. Preferably, the frequency is chosen so that the corresponding return loss is above the "50% line top", and more preferably it is chosen so that the corresponding return loss is at its global maximum.

When choosing a frequency for low absorption, it means that the return loss corresponding to the frequency has to be lower than the median of the scan. Preferably, the frequency is chosen so that the corresponding return loss is below the "50% line bottom", and more preferably it is chosen so that the corresponding return loss is at its global minimum.

Figure 2:
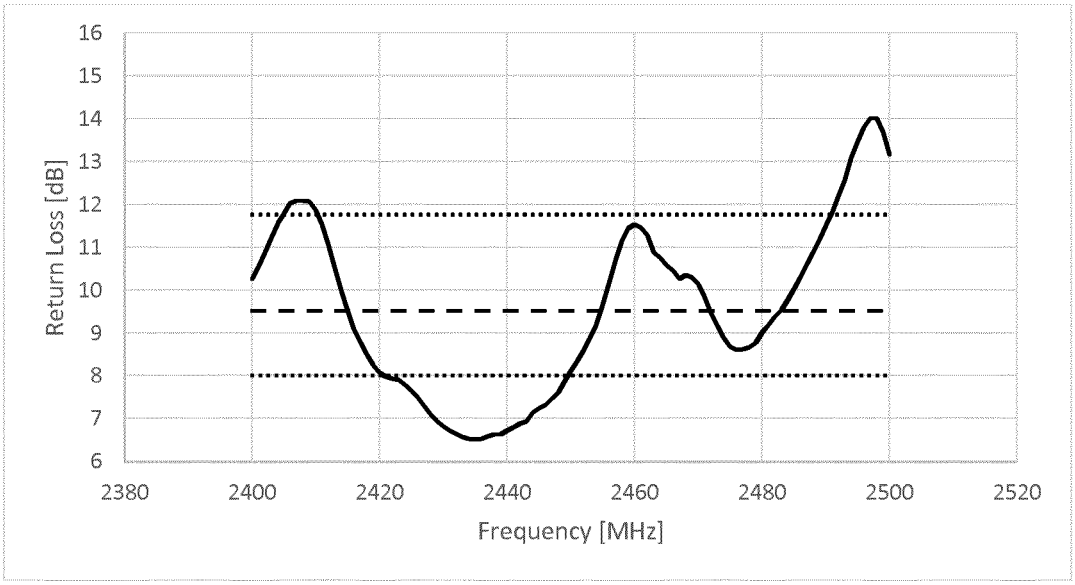
FIG. 2: Radio frequency sweep for determining the frequency for the second Phase heating step of Example 2. Solid line is the frequency sweep; the heavy dotted line is the median value of the frequency sweep; the light dotted lines are the mean values between the median and the maxima and minima values, respectively.
Figure 2:
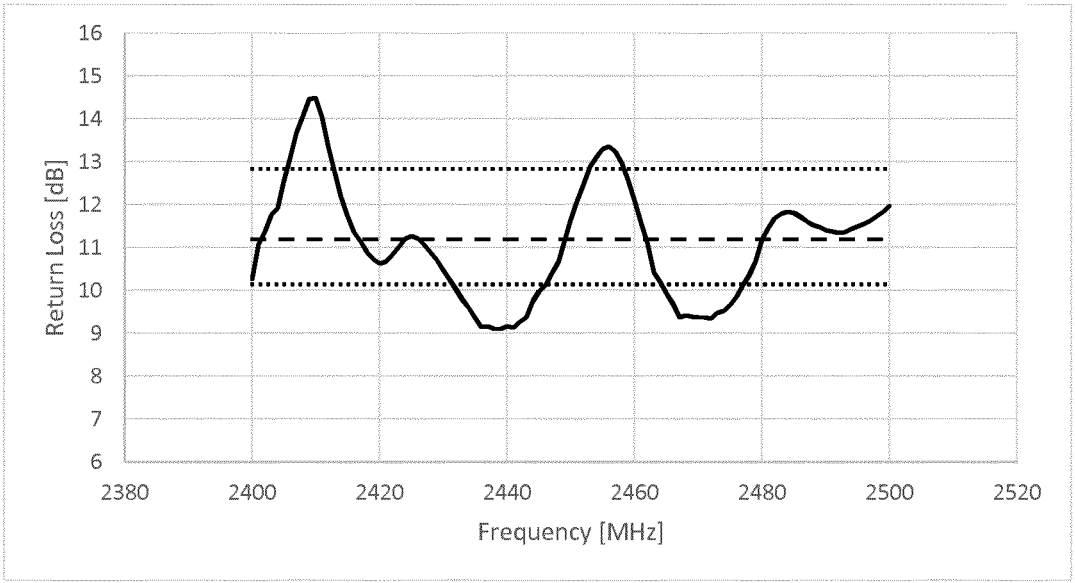

Tested Examples According to Table 1:

1. Sharp Carousel Microwave (Magnetron: 1100 Watts): Product is cooked for 3 minutes as indicated by the supplier and measured for performance.
2. Ampleon Solid State Oven—High Absorption (Reference test):
   Only one heating step as Phase 1—A fixed frequency was selected based on the highest absorption. The product was cooked at a total of 6 minutes and 30 seconds at 2495 MHz.
3. Ampleon Solid State Oven—High Absorption/Low Absorption:
   For the two phase (two heating step) method, we divided the cooking stages into two. First being a cooking methodology where we cook at a high absorption frequency, followed by cooking at a low absorption frequency. However, at all times the four channels of the experimental oven were operated at the same frequency as follows:
   Phase 1—A fixed frequency was selected based on the highest absorption. The product was cooked for 2 minutes and 45 seconds at 2495 MHz
   Phase 2—A fixed frequency was selected based on the lowest absorption. The product was cooked for 2 minutes and 30 seconds at 2470 MHz
   The radio frequency scans (sweeps) before Phase 1 and before Phase 2 are shown in FIGS. 1A and 1B, respectively.
   The product was cooked for a total of 5 minutes and 15 seconds.
4. Ampleon Solid State Oven Low Absorption/High Absorption (Method of the present invention)
   For the two phase (two heating step) method, we divided the cooking stages into two. First being a cooking methodology where we cook at a low absorption frequency followed by cooking at a high absorption frequency. However, at all times the four channels of the experimental oven were operated at the same frequency as follows:
   Phase 1—A fixed frequency was selected based on the lowest absorption. The product was cooked for 3 minutes and 15 seconds at 2435 MHz
   Phase 2—A fixed frequency was selected based on the highest absorption. The product was cooked for 2 minutes and 45 seconds at 2409 MHz
   The radio frequency scans (sweeps) before Phase 1 and before Phase 2 are shown in FIGS. 2A and 2B, respectively.
   The product was cooked for a total of 6 minutes and 15 seconds.

Results:

Table 1 highlights the overall results of the DiGiorno pizza study.

TABLE 1

Comparison of performance of the single serve DiGiorno pizza when heated in the solid state microwave oven. Results of a 1100 Watt magnetron based oven are also provided as a comparison

Figure 3:
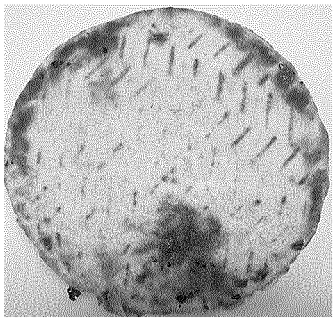
FIG. 3: Pictures of the bottom surfaces of the pizza products tested in Example 2.
Figure 3:
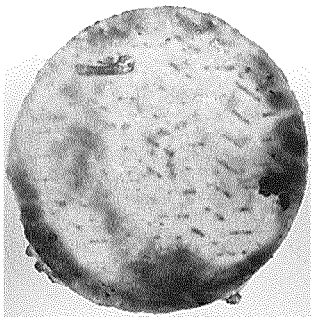
Figure 3:
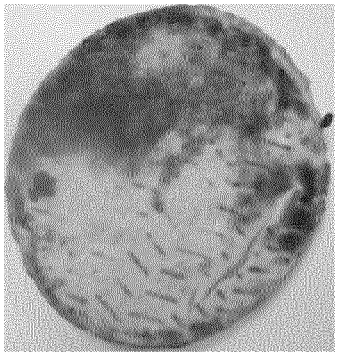
Figure 3:
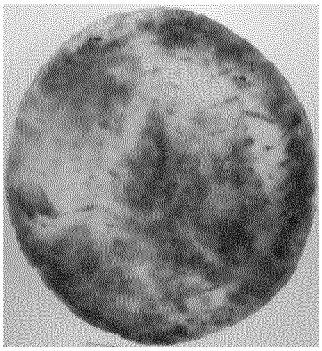

| Types of Ovens & Phases of Cooking | Time Min:Sec | Weight Loss Percent | Base Browning Percentage | Visual Observation (Bottom Surface) | Comments |
|---|---|---|---|---|---|
| Sharp Carousel Microwave (Magnetron: 1100 Watts) | 3:00 | 10 | 17.81 | FIG. 3A | Uneven browning, and no crispiness |
| Ampleon Solid State Oven - High Absorption | 6:30 | 15.03 ± 0.6 | 32.89 ± 8.5 | FIG. 3B | Uneven & Little browning, crispiness throughout, |

TABLE 1-continued

Comparison of performance of the single serve DiGiorno pizza when heated in the solid state microwave oven. Results of a 1100 Watt magnetron based oven are also provided as a comparison

| Types of Ovens & Phases of Cooking | Time Min:Sec | Weight Loss Percent | Base Browning Percentage | Visual Observation (Bottom Surface) | Comments |
|---|---|---|---|---|---|
| | | | | | more toughness |
| Ampleon Solid State Oven - High Absorption/Low Absorption | 5:15 | 10 ± 0.1 | 36.19 ± 3.9 | FIG. 3C | Uneven browning, crispiness throughout, more toughness |
| Ampleon Solid State Oven - Low Absorption/High Absorption | 6:15 | 12 ± 1 | 57.25 ± 4.1 | FIG. 3D | Even browning, crispiness throughout, very little toughness |

Conclusion

Cooking times of the reference and our proposed cooking methodology are nearly the same, but we achieve significantly higher surface browning on the bottom of the pizza as compared to the reference. The percentage weight loss is also in the acceptable range of below 15%. The pizza heated according to the proposed method also shows more even browning and less toughness compared to the reference.

Example 3: Hot Pocket Products (Multi-Frequency)

This section highlights the results of improved browning and crispiness of a Hot Pocket food product by optimizing the method of heating in a solid state microwave oven. The results from operating the experimental oven at multiple frequencies (each of the four channels being operated at a different frequency) are presented. The setup of the experiment was the same as in Example 2 with the following modifications:

Sharp Carousel microwave (Magnetron 1100 Watts): The product was placed in the centre on the turntable with the use of the susceptor as directed in the cooking instruction label. The Product was cooked for 2 minutes and measured for performance.

Ampleon Experimental Solid State Combination Oven: The product was placed in the centre on the turntable with the use of the susceptor. For all trials, the products were placed exactly at the same location to ensure repeatability. The cooking methodology in the solid state oven was either a one phase or two phase method as described in Example 2.

Our reference test for this study was a one phase method where a high absorption frequency (based on return loss data) was selected for each channel separately, following the frequency sweep between 2400-2500 MHz. All four channels of the experimental oven were operated at different frequencies as follows:

Ampleon Solid State Oven—High Absorption (Reference test):

Phase 1—Frequencies were selected based on the highest absorption, which was:
- Channel 1: 2401 MHz
- Channel 2: 2410 MHz
- Channel 3: 2445 MHz
- Channel 4: 2448 MHz For the two phase method, we divided the cooking process into two stages. First being a cooking methodology where we cook at a high absorption frequency (high absorption for each of the channels) followed by cooking at a low absorption frequency for each channel. The four channels of the experimental oven were operated as follows:

Ampleon Solid State Oven—High Absorption/Low Absorption:

Phase 1—Frequencies were selected based on the highest absorption. The product was cooked for 2 minutes at:
- Channel 1: 2400 MHz
- Channel 2: 2410 MHz
- Channel 3: 2445 MHz
- Channel 4: 2448 MHz Phase 2—Frequencies were selected based on the lowest absorption. The product was cooked for 1 minute and 45 seconds at:
- Channel 1: 2471 MHz
- Channel 2: 2470 MHz
- Channel 3: 2482 MHz
- Channel 4: 2480 MHz The product was cooked for a total of 3 minutes and 45 seconds.

Ampleon Solid State Oven Low Absorption/High Absorption (Method of the Present Invention):

Phase 1—Frequencies were selected based on the lowest absorption to defrost the product. The product was cooked for 2 minutes at:
- Channel 1: 2471 MHz
- Channel 2: 2470 MHz
- Channel 3: 2482 MHz
- Channel 4: 2484 MHz Phase 2—Frequencies were selected based on the highest absorption to form the crisping and browning. The product was cooked for 1 minute and 45 seconds at:
- Channel 1: 2401 MHz
- Channel 2: 2410 MHz
- Channel 3: 2454 MHz
- Channel 4: 2445 MHz The product was cooked at a total of 3 minutes and 45 seconds.

Results:

Table 1 highlights the overall results of the Hot Pocket food product study.

TABLE 1

Comparison of performance of the Hot Pocket product when heated at a multiple frequency in a solid state microwave oven. Results of a 1100 Watt magnetron based oven is also provided as a comparison.

Figure 4:
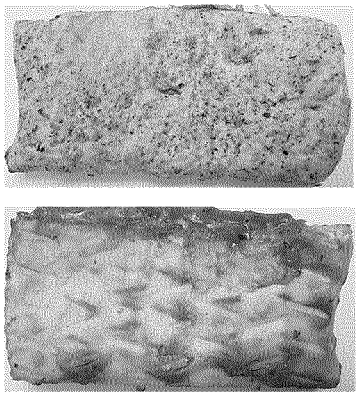
FIG. 4: Pictures of both sides of the Hot Pocket products tested in Example 3.
Figure 4:
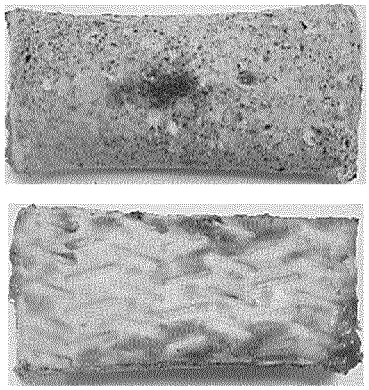
Figure 4:
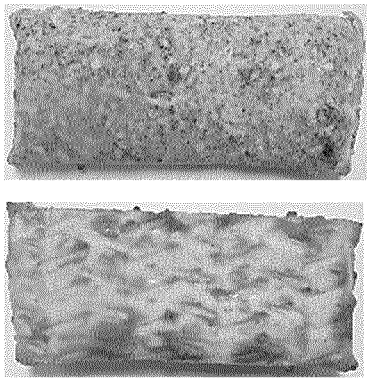
Figure 4:
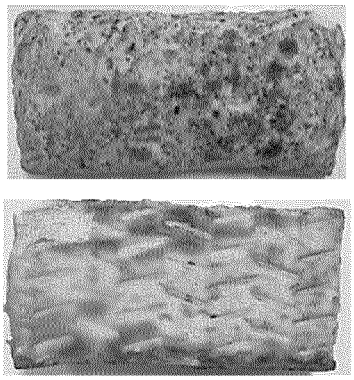

| Types of Ovens & Phases of Cooking | Time (Min) | Weight Loss Percent | Surface & Base Browning Percentage | Visual Observation | Comments |
|---|---|---|---|---|---|
| Sharp Carousel Microwave | 2 | 12.2 | 8.310 | FIG. 4A | No crispiness, little browning on base, more toughness |
| Ampleon Solid State Oven - High Absorption | 2.5 | 9 ± 2 | 19.94 ± 8.3<br>11.91 ± 7.1 | FIG. 4B | Uneven browning, crispiness throughout, more toughness |
| Ampleon Solid State Oven - High Absorption/ Low Absorption | 3.75 | 12 ± 1.5 | 22.37 ± 7.5<br>17.39 ± 3.9 | FIG. 4C | Very little browning, very little crispiness, more toughness |
| Ampleon Solid State Oven - Low Absorption/ High Absorption | 3.75 | 9 ± 1.1 | 29.43 ± 6.9<br>16.47 ± 4.6 | FIG. 4D | Even browning, crispiness throughout, very little toughness |

CONCLUSION

Significantly higher overall browning was achieved on the top and bottom dough surfaces of the Hot Pocket product with the proposed method compared to the reference. The percentage weight loss was also in the acceptable range of below 10%. The sample heated according to the proposed method showed higher crispiness, more even browning, and less toughness compared to the reference.

The invention claimed is:

1. A method for heating a frozen food product with a susceptor in a solid state microwave oven, the method comprising the following steps in the following order:

a) placing the frozen food product with the susceptor into a cavity of a solid state microwave oven;

b) performing a radio frequency sweep between a predetermined minimal and maximal frequency for all channels;

c) analyzing the compound power return loss over the entire swept frequency range;

d) heating the food product in a first heating step at a radio frequency where the compound power return loss is below the median value of the total compound return loss determined over the entire swept frequency range; and e) heating the food product in a second heating step at a radio frequency where the compound power return loss is above the median value of the total compound return loss determined over the entire swept frequency range.

2. The method according to claim 1, wherein the radio frequency sweep in step b) is from 2400 to 2500 MHz.

3. The method according to claim 1, wherein the radio frequency sweep in step b) is done separately for each channel.

4. The method according to claim 1, wherein the radio frequency sweep in step b) is done collectively for all channels with constant phase angle.

5. The method according to claim 1, wherein the first heating step in step d) is for a duration to defrost at least 50 vol % of the food product.

6. The method according to claim 5, wherein the first heating step in step d) is for a duration to defrost at least 80 vol % of the food product.

7. The method according to claim 6, wherein the first heating step in step d) is for a duration to completely defrost the food product.

8. The method according to claim 1, wherein the first heating step in step d) is for a duration of at least 1.5 min.

9. The method according to claim 1, wherein the first heating step in step d) is at a radio frequency where the compound power return loss is below an arithmetic mean of the median value and the minimal value of return loss determined over the entire swept frequency range and calculated on a decibel basis.

10. The method according to claim 1, wherein the first heating step in step d) is at a radio frequency where the compound power return loss is at the minimum of the entire swept frequency range.

11. The method according to claim 1, wherein the second heating step in step e) is at a radio frequency where the compound power return loss is above an arithmetic mean of the median value and the maximal value of return loss determined over the entire swept frequency range and calculated on a decibel basis.

12. The method according to claim 1, wherein the second heating step in step e) is at a radio frequency where the compound power return loss is at the maximum of the entire swept frequency range.

13. The method according to claim 1, wherein the second heating step in step e) is for a duration of at least 1.5.

14. The method according to claim 1, wherein the steps b) and c) are repeated before the second heating step of step e).

15. The method according to claim 14, wherein the combination of the steps b), c) and e) is repeated at least twice.

16. The method according to claim 1, wherein the frozen food product is selected from the group consisting of a pizza product, a sandwich product, a bread product, an enrolled dough product with a filling, and a prepared meal product.

* * * * *